United States Patent [19]

Holmes

[11] 4,083,082

[45] Apr. 11, 1978

[54] CONCEALED SELF-CLOSING HINGE FOR PANEL DOOR CABINET STRUCTURE

[75] Inventor: Frank A. Holmes, Ballasalla, Isle of Man

[73] Assignee: Jaybee Manufacturing Corporation, Los Angeles, Calif.

[21] Appl. No.: 740,766

[22] Filed: Nov. 10, 1976

[51] Int. Cl.[2] ..... E05D 3/06; E05D 3/08; E05D 3/10; E05D 15/52

[52] U.S. Cl. ..... 16/163; 16/145; 16/180; 16/183

[58] Field of Search ..... 16/50, 145, 128, 163, 16/183, 164, 180, 176

[56] References Cited

U.S. PATENT DOCUMENTS

| | | | |
|---|---|---|---|
| 3,224,035 | 12/1965 | Heinze | 16/163 |
| 3,362,042 | 1/1968 | Salice | 16/163 |
| 3,564,643 | 2/1971 | Salice | 16/163 |
| 3,590,420 | 7/1971 | Salice | 16/164 |
| 3,605,173 | 9/1971 | Lautenschlager | 16/163 |
| 3,724,021 | 4/1973 | Lautenschlager | 16/164 |
| 3,744,086 | 7/1973 | Salice | 16/164 |
| 3,772,736 | 11/1973 | Hettich et al. | 16/183 |
| 3,864,786 | 2/1975 | Salice | 16/163 |
| 3,940,829 | 3/1976 | Grunert | 16/163 |
| 3,952,368 | 4/1976 | Zering et al. | 16/180 |
| 3,968,540 | 7/1976 | Lautenschlager et al. | 16/164 |
| 3,975,791 | 8/1976 | Hettich et al. | 16/145 |

FOREIGN PATENT DOCUMENTS

| | | | |
|---|---|---|---|
| 2,401,178 | 7/1975 | Germany | 16/145 |
| 2,432,828 | 1/1975 | Germany | 16/50 |
| 2,408,057 | 8/1975 | Germany | 16/145 |
| 2,357,612 | 5/1975 | Germany | 16/145 |
| 2,439,314 | 2/1976 | Germany | 16/145 |

*Primary Examiner*—Ronald Feldbaum
*Attorney, Agent, or Firm*—Flam & Flam

[57] ABSTRACT

A cabinet structure has side-by-side slab cabinet doors that nearly abut each other. Linkage elements, mounted on the inside, support the doors for a compound pivotal movement whereby the initial opening movement of the door includes a shifting component so that the door does not invade the space occupied by the adjacent door. A spring arrangement provides not only a self-closing operation, but also a shock mounting in the open position whereby high leverage stresses upon the hardware is eliminated.

7 Claims, 8 Drawing Figures

FIG. 1.
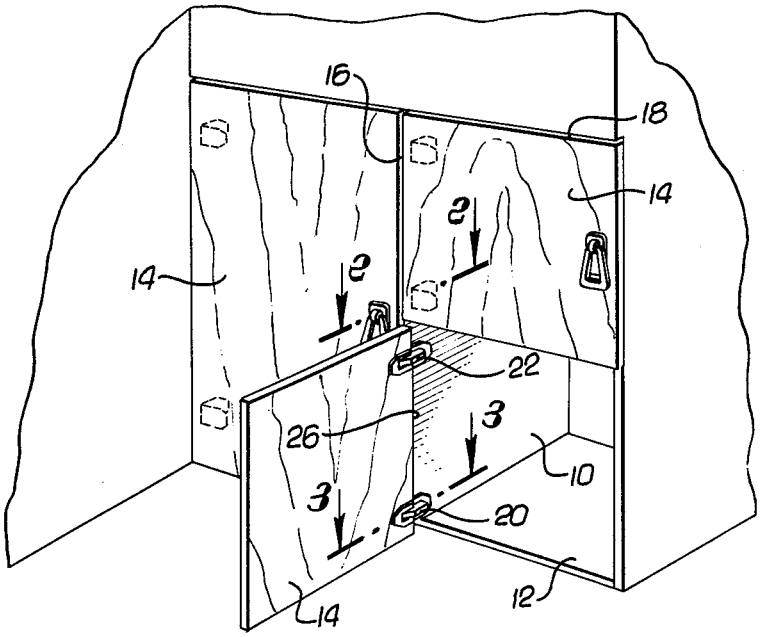
FIG. 2.
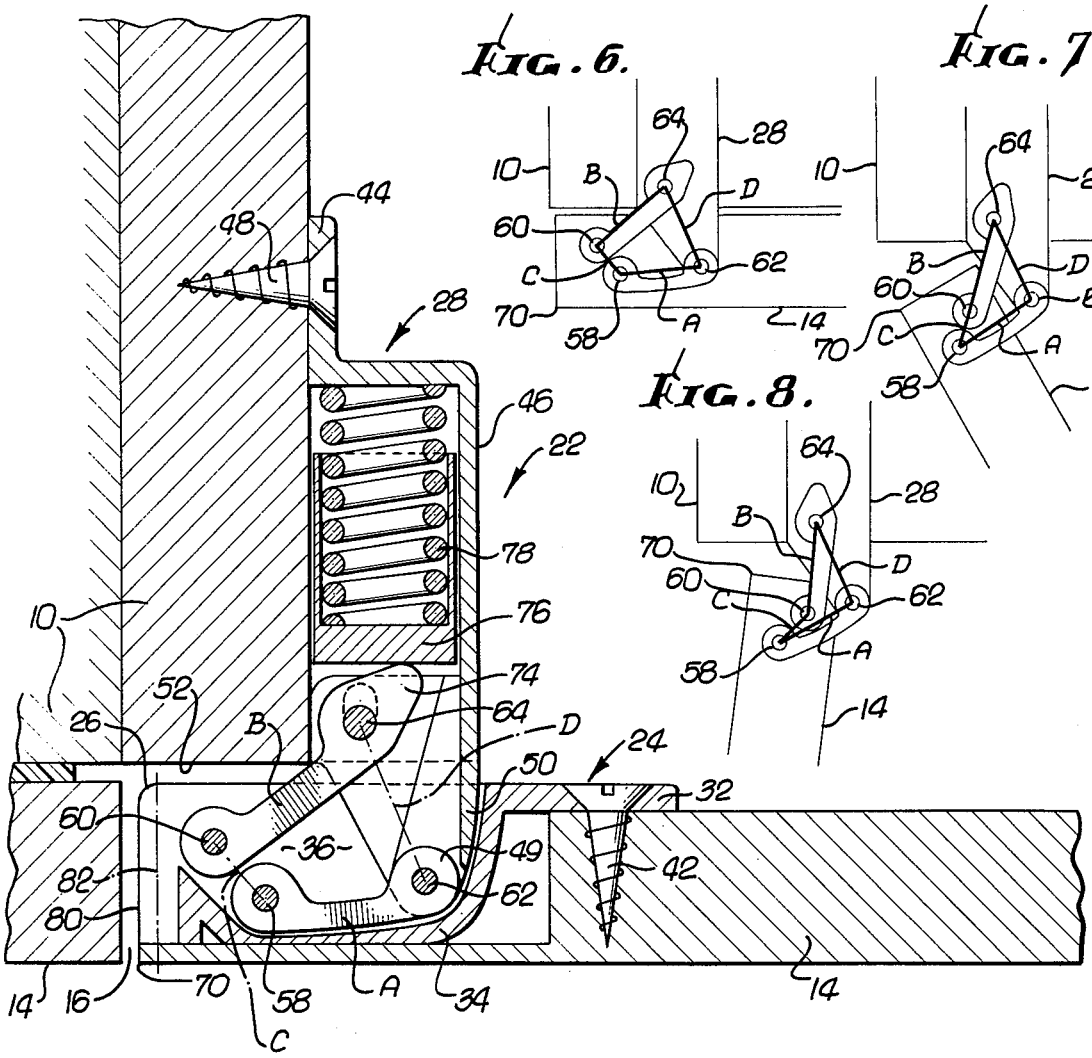
FIG. 6.
FIG. 7.
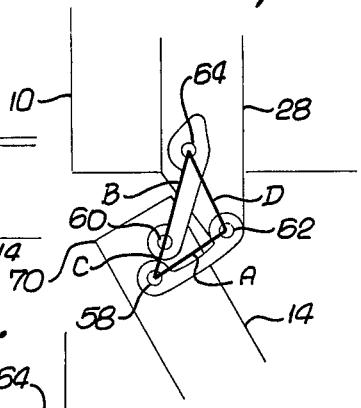
FIG. 8.

CONCEALED SELF-CLOSING HINGE FOR PANEL DOOR CABINET STRUCTURE

FIELD OF INVENTION

This invention relates to cabinet hardware, and particularly to concealed hinges having a composite linkage structure.

BACKGROUND OF THE INVENTION

An esthetically pleasing effect is produced in a multidoor cabinet structure by positioning slab cabinet doors in proximity so that only a very narrow gap or reveal exists between the closed doors. The effect is heightened when the doors are veneered with contiguous components of common facing materials. Such a cabinet structure requires concealed hinges. Moreover, the hinges must mount the doors in such manner that the doors never infringe upon the space occupied by the adjacent door. Quadrilateral linkages are known to achieve this result. Two elements of the quadrilateral are hinge leaves attached respectively to the door and the frame. Two other small links between the hinge leaves complete the linkage structure.

One known quadrilateral hinge structure incorporates a detent-like latch that requires a positive effort on the part of the user in order to operate. Far more acceptable is an arrangement in which spring means incorporated in the hinge itself positively closes the cabinet door without requiring such positive effort.

This known quadrilateral hinge structure, like many hinge structures, does not include a stop to limit opening movement of the cabinet door. The unjustified assumption is made that excessive opening will not be exerted. But, forces are often unintentionally exerted on the linkage. The forces are high due to the very high force multiplication resulting from the small distances to the hinge pivot point as compared with the door width. To incorporate a stop requires the use of massive and exceedingly strong structures. Even if the hinge itself can withstand the high cranking forces, the mounting of the hinge leaves may fail.

The primary object of the present invention is to provide an improved quadrilateral hinge structure for concealed contiguous mounting of slab doors.

SUMMARY OF THE INVENTION

In order to accomplish the foregoing object, I provide a quadrilateral linkage in which one of the links has a cam extension that cooperates with a spring conveniently mounted in one of the hinge leaves. The spring cooperates with the cam extension to provide self-closing features. By allowing the pivot point of one of the links yieldingly to move from a normal pivot position under increasing stress of a spring, a novel spring stop is incorporated in the hinge structure. Instead of a positive stop, the stop absorbs shock whereby the imposition of high forces is precluded. By a unique arrangement, the same spring provides both functions. A compact arrangement is provided.

Essentially the same hinge element is adapted for use with frames of different thickness. This is done by trimming a skirt of the hinge element. Optionally, a die insert can provide hinge elements for various cabinet structures.

BRIEF DESCRIPTION OF DRAWINGS

A detailed description of the invention will be made with reference to the accompanying drawings wherein like numerals designate corresponding parts in the several figures. These drawings, unless described as diagrammatic or unless otherwise indicated, are to scale.

FIG. 1 is a pictorial view of a cabinet incorporating the present invention.

FIGS. 2 and 3 are enlarged sectional views of the hinge elements shown in closed and open positions respectively, there being illustrated in phantom lines in FIG. 3, an intermediate position of the cabinet door.

FIGS. 6, 7 and 8 are diagrammatic views of the quadrilateral hinge linkage shown in closed, intermediate and open positions respectively.

DETAILED DESCRIPTION OF PREFERRED EMBODIMENT

Figure 3:
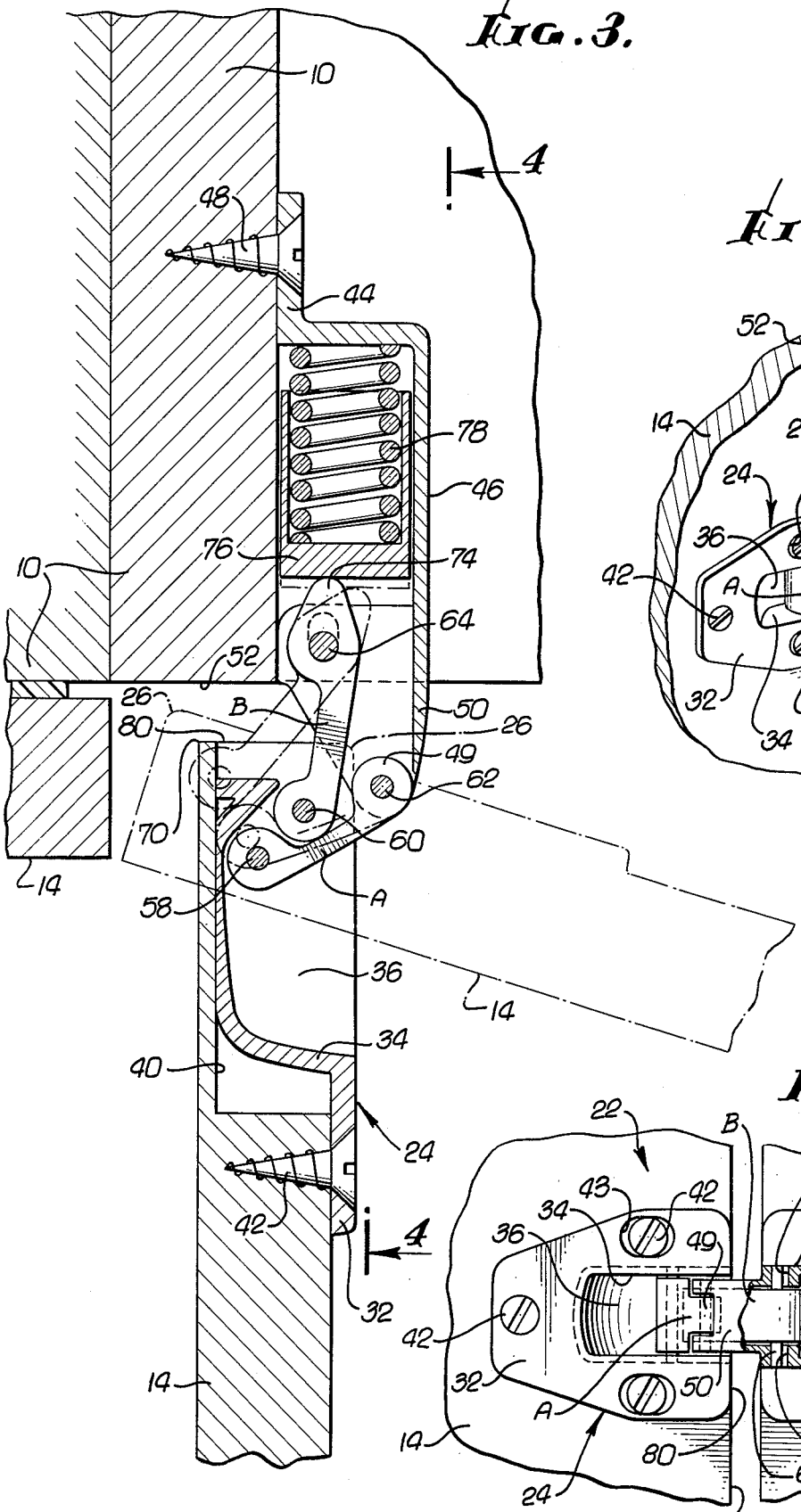

The following detailed description is of the best presently contemplated mode of carrying out the invention. This description is not to be taken in a limiting sense, but is made merely for purposes of illustrating the general principles of the invention since the scope of the invention is best defined by the appended claims.

The cabinet structure illustrated in FIG. 1 includes a conventional frame structure that includes vertical frame elements 10 and horizontal frame elements 12, some of which form cabinet shelves. The spaces defined by the frame elements are closed by slab doors 14 that are placed very close together, leaving only very narrow vertical gaps 16 and horizontal gaps 18 between them.

In the present instance, the slab doors 14 are typically mounted for opening movement about generally vertical hinge axes. The hinges are so constructed that the doors upon opening do not infringe upon the space occupied by the adjacent slab door, close spacing of the doors notwithstanding. For this purpose, two hinge structures 20 and 22 are provided for each door.

Figure 5:
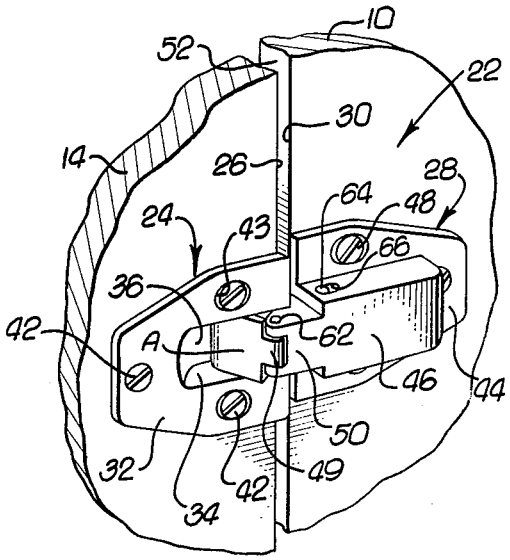
FIG. 5 is a pictorial view of the hinge elements in open position.

The hinge structure 22 (FIG. 5) include two leaves, one leaf 24 being mounted on the inside of the door adjacent the inside door edge 26 and another leaf 28 being mounted on the cabinet frame 10 adjacent inside edge 30 of the cabinet opening. The door hinge leaf 24 has a plate or attachment part 32 that forms a flange around the edge of a long cup or trough 34. The cup provides a recess 36 for operative hinge parts to be described hereinafter. As shown in FIGS. 2 and 3, the door has a recess 40 on its inside at the edge 26 in order to accommodate the cup 34 with the attachment plate 32 fitted about the recess edges. Screws 42 (FIG. 5) secure the hinge leaf 24 to the inside of the door. Slots 43 (FIG. 4) in the plate 32 allow for initial lateral adjustment of the hinge leaf.

The companion hinge leaf 28 has an attachment plate part 44 that suurounds a hollow outwardly projecting case 46. Screws 48 secure the hinge leaf 28 to the frame 10 with the edge of the plate flush with the frontal edge 30 of the frame. The case 46 has a reduced protuberance 50 that extends frontally of the frame 10 to enter the cup (FIG. 2) of the companion hinge leaf 24 when the door is closed.

With the door 14 closed (FIG. 2), the hinge leaves 24 and 28 are positioned generally in right angle relationship with each other with the protuberance 50 extending into the cup 34 at the end remote from the door edge. The hinge leaf 24 generally crosses the companion leaf 26 and projects over the frontal surface 52 of the vertical frame element 10. The hinge leaves 24 and 28 are connected together by two links, an outer link A and an inner link B, of slightly different lengths. Both links have first ends accommodated in the trough or cup 34 where they are pivotally connected to the cup by pins 58 and 60. The outer link A nests in the bottom of the cup as shown in FIG. 2 with its other or second end provided with a knuckle 49 (FIG. 5) pivotally connected to the protuberance 50, as by a pin 62. The other or second end of the inner link B carries a pin 64 (FIG. 2) that works in slots 66 and 68 of the case 46 (see also FIG. 4) that are elongated in a front and back direction or substantially parallel to the attachment plane of the cabinet mounted hinge leaf 28. These mounting slots are located near the front of the case just inwardly of the protuberance 50. The door hinge leaf 24 connects corresponding ends of the links A and B and forms one side C (FIGS. 6, 7 and 8) of a quadrilateral. The frame hinge leaf 28 forms the opposite side D, connecting the opposite ends of the links. The quadrilateral ABCD is foldable since it has a permitted degree of geometric freedom. The course of movement of the door hinge leaf 24 and the door 14 mounted thereby are thus determined by the geometry of the quadrilateral. Links A and B are movable in arcs centered about the pins 62 and 64 while the quadrilateral side C couples the links A and B. In the closed position of FIGS. 2 and 6, the links A and B generally overlie each other in the cup, the angle between sides A and C being quite obtuse. When the door 14 and hinge leaf 24 are moved to open position, the pivot pin 60 moves in its arc towards the opposite pivot point 62, cranking the pivot point 58 outwardly as the obtuse angle moves to close. The door corner 70 has very little movement at first and the inside edge 26 rotates outwardly and as shown in the phantom line position of FIG. 3. Accordingly, the door 14 does not infringe upon the space of the adjacent door or wall.

The quadrilateral sides A and C can be considered to form elements of a toggle that somewhat approach alignment in the closed position of the door. The elements of this toggle break open when the door is opened. The sides B and D form rigid toggle arms of the linkage.

The door mounted hinge leaf 24 is yieldingly maintained closed. For this purpose, the link B has its knuckle position 74 (FIGS. 2 and 3) about the pin 64 formed as a cam. This knuckle portion 74 projects angularly into the case 46 (see also FIG. 4) to engage the end of a hollow thrust member 76 slidingly accommodated in the case. The thrust member 76 is urged outwardly of the case by a compression spring 78 fitted inside. The thrust member is guided for movement inwardly along the frame and outwardly toward the pivot pin 64 which blocks its outward movement. In the closed position of FIGS. 2 and 6, the cam 74 is positioned to one side of the pin 64. Accordingly, the thrust member 76 tends to move the link B in a clockwise direction as viewed in FIGS. 2 and 6. This movement direction tends to pull the quadrilateral side C inwardly of the frame and correspondingly tends to move the door side C in a counterclockwise direction about the pin 60, all corresponding to closing of the door 14.

As the door is opened, the link B moves in a direction to cause the cam 74 slowly and gradually to compress the spring 78. As the open position of the door 14 is approached, the cam 78 moves nearly into alignment with the pin 64 so that the torque arm is reduced to zero or near zero. Accordingly, in the open position of the door, the spring 78 does not return the door to closed. Instead, the spring imposes a desired frictional restraint against door movement. As the door is returned towards closed position, the torque arm increases and the spring takes over for selfclosing operation.

The open position of the door is not determined by any engagement of the door with the frame. Instead, the linkage ABCD itself limits opening movement. As the door moves from closed towards open position, the link B (FIGS. 6 and 7) swings counterclockwise. The companion link A has a toggle movement, at first moving in a counterclockwise direction until an intermediate position (FIG. 7) is reached in which the links B and C are in line. Continued movement of the link B now causes the companion link A to begin a return or clockwise movement to intercept the swinging link C. Shortly (FIG. 8) the knuckle surrounding the pin 60 impinges on the center of the link A and motion is arrested as the link B is now about perpendicular to the cabinet opening. As the door is carried into the open position, the link A, swinging now in a clockwise direction, cranks the link B inwardly of the frame from the position of FIGS. 3 and 8. Such movement is permitted by virtue of the slots 66, 68 and the limited lost motion connection between the link B and the hinge leaf 28. As the link B is cranked inwardly, the thrust member 76 causes the spring 78 to compress. A shock absorbing stop is thus provided for the door. Imposition of high stresses are positively avoided. Except when the door is cranked beyond its full open position, the pivot pin 64 remains bottomed in its slot for normal quadrilateral door suspension.

Figure 4:
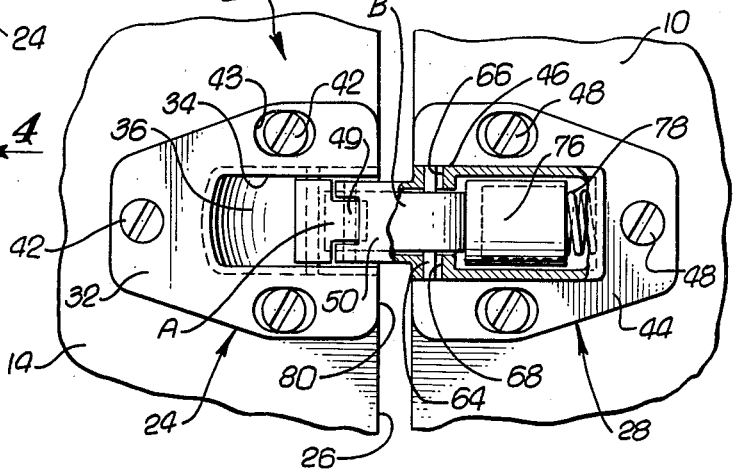
FIG. 4 is an elevational view of the hinge elements in open position, part of the spring case being broken away and shown in section.

The thickness of the frame element 10 may vary depending upon the specifications of the cabinet manufacturer. Often the frame element is a standard one-half inch. As shown in FIG. 4, the edge 80 of the door hinge leaf 24 is flush with the edge 26 of the door. If required by a greater thickness of the frame element 10, adjustment may be made by means of the slots 44, whereby the hinge leaf edge 80 moves inwardly of door edge 26. If the frame element 10 is of lesser thickness, then the overlap of the door by the hinge leaf 24 must be reduced. The hinge leaf 24 can be trimmed at the edge 80 as indicated by the line 82 (FIG. 2). Optionally, a simple die insert can produce hinge leaves of lesser dimension without interference with the linkage mechanism.

The hinge mechanism provides a number of desirable functions notwithstanding its basic simplicity. A slab door suspension is provided in which the doors can be nearly abutted. A self-closing function is provided along with frictional restraint at the open position. Shock absorbing stopping is achieved at the open position. The hinge structure is easily installed.

Intending to claim all novel, useful and unobvious features shown or described, I make the following claims:

1. In a hinge structure for a cabinet door:

(a) a pair of hinge leaves for attachment to the frame and the inside of the door respectively;

(b) a pair of links each pivotally connected at opposite ends to the respective hinge leaves, said links and said hinge leaves forming a quadrilateral structure having a degree of freedom to determine the course of movement of the door as the quadrilateral folds in opposite directions;

(c) one of said links having a cam surface;

(d) a compression spring mounted by one of said hinge leaves, said compression spring being coupled to said cam surface to urge said quadrilateral in one folding direction corresponding to door closing; and (e) a limited lost motion between said one of said links and said one hinge leaf, and providing a path of relative movement therebetween to change the length of one side of said quadrilateral, said spring urging said one link to one end of its travel in said lost motion path, said one of said links being engaged by the hinge structure at the open position of said door to crank said one link against the force of said spring thus to provide a shock absorbing stop to opening movement of said door.

2. In a hinge structure for a frame having frame elements defining a cabinet opening located in a plane and having a door overlying said opening, said door having an inside edge recess, the combination therewith of:

(a) a first hinge leaf attached to said frame and having an elongate hollow case part extending substantially perpendicular to the plane of said opening, said case part having, at its distal portion, a protuberance projecting frontally through the plane of said opening;

(b) a second hinge leaf attached at the inside edge recess of said door, said second hinge leaf having a cup part extending substantially parallel to said opening from a place adjacent the edge of said door, one end of said cup part being sized to receive said protuberance when said door is in closed position;

(c) a pair of juxtaposed links, one link being an outer link pivoted at opposite ends respectively to said second hinge leaf at the edge end of said cup part and to said protuberance, the other link being an inner link and being pivotally connected at opposite ends to the edge end of said cup part and to the proximal portion of said case part at said opening;

(d) the outer link and said second hinge leaf forming toggle elements movable to approach in-line relationship when said door is in closed position, said toggle like suspension being positioned and proportioned for outward swinging movement of said door with minimal movement laterally of said cabinet opening;

(e) a thrust member slideable in, and guided by, said case part;

(f) a coiled spring in said case and urging said thrust member outwardly of said opening;

(g) said inner link having a projecting cam part in sliding crank relationship with said thrust member whereby said spring urged thrust member biases said toggle arms in a direction corresponding to door closing position.

3. The combination as set forth in claim 2 in which a pin extends acroos the open end of said case part to mount said inner link in position to capture said spring in said case.

4. The combination as set forth in claim 2 in which said cam part is movable to a position of substantial equilibrium of near zero torque arm when said door is moved substantially from its closed position.

5. The combination as set forth in claim 2 in which pin and slot means comprise the pivotal connection between inner link and said proximal portion of said case part, said pin and slot means permitting movement between said case part and said inner link in a direction inwardly and outwardly of said frame opening, the end of the slot means determining an outward limit to the position of said inner link, said thrust member acting through said cam part to urge said inner link to said outward limit, said inner link moving inwardly of said door beyond a normal full open position whereby said spring forms a yielding, shock absorbing stop.

6. The combination as set forth in claim 4 in which said cam part is movable to a position of substantial equilibrium of near zero torque arm when said door is moved substantially from its closed position.

7. In a hinge structure for a cabinet having a frame and a door:

(a) a pair of hinge leaves for attachment to the frame and the inside of the door respectively;

(b) a pair of links each pivotally connected at opposite ends to the respective hinge leaves, said links and hinge leaves forming elements of a quadrilateral having a degree of freedom to determine the course of movement of the door as the quadrilateral folds in opposite directions, elements of said quadrilateral mutually engaging each other to determine a limit to the opening movement of said quadrilateral;

(c) the pivotal connection between two of said quadrilateral elements being formed by a limited lost motion connection; and (d) spring means urging said lost motion connection to one limit to determine a normal course of folding movement of said quadrilateral, said spring means yielding upon the imposition of torque tending to move said linkage beyond said limit whereby a shock absorption is provided for opening movement of said quadrilateral.

* * * * *